US005413650A

United States Patent [19]

Jarrett et al.

[11] Patent Number: 5,413,650

[45] Date of Patent: May 9, 1995

[54] DUCTILE ULTRA-HIGH STRENGTH ALUMINIUM ALLOY COMPONENTS

[75] Inventors: Martin R. Jarrett, Southam; William Dixon, Egremont, both of United Kingdom

[73] Assignee: Alcan International Limited, Montreal, Canada

[21] Appl. No.: 971,844

[22] PCT Filed: Jul. 30, 1991

[86] PCT No.: PCT/GB91/01286

§ 371 Date: Mar. 8, 1993

§ 102(e) Date: Mar. 8, 1993

[87] PCT Pub. No.: WO92/02655

PCT Pub. Date: Feb. 20, 1992

[30] Foreign Application Priority Data

Jul. 30, 1990 [GB] United Kingdom ..... 9016694

[51] Int. Cl.[6] ..... C22F 1/04

[52] U.S. Cl. ..... 148/690; 72/352; 72/710; 148/695; 148/697; 148/701; 148/437; 148/439

[58] Field of Search ..... 148/690, 695, 697, 701, 148/437, 439; 72/352, 353.2, 710; 29/DIG. 43, DIG. 46, DIG. 47; 428/577, 583, 585

[56] References Cited

U.S. PATENT DOCUMENTS

| | | | |
|---|---|---|---|
| 3,622,404 | 11/1971 | Thompson | 72/710 |
| 4,001,053 | 1/1977 | Igisu | 148/558 |
| 4,462,238 | 7/1984 | Goodfellow | 72/352 |
| 4,797,165 | 1/1989 | Bretz et al. | 148/695 |
| 4,861,391 | 8/1989 | Rioja et al. | 148/701 |

FOREIGN PATENT DOCUMENTS

| | | |
|---|---|---|
| 0222479 | 5/1987 | European Pat. Off. . |
| 2124938 | 7/1983 | United Kingdom . |

OTHER PUBLICATIONS

K. R. Van Horn "Aluminium" vol.3: Fabrication and Technology, Dec. 1967, American Society for Metals, Ohio; C. R. Anderson et al Extrusion.

Metals Abstract vol. 14, No.1, p. 49, Materials Information, London GB Dec. 1981 Abstract No. 22-0054 R. A. Claxton, "Vibratory Stress Relieving–Practice and Theory".

Materials Science And Engineering: vol. 61, No. 1, Dec. 1983, Amsterdam, NL, pp. 67–77; M. M. Shea et al: "Enhanced Age Hardening of 7075 Aluminium Alloy After Ultrasonic Vibration".

*Primary Examiner*—Scott Kastler
*Assistant Examiner*—Robert R. Koehler
*Attorney, Agent, or Firm*—Cooper & Dunham

[57] ABSTRACT

The mechanical properties of aluminium alloy extrusion in a specified transverse direction are improved by upsetting the extrusion billet in at least one direction chosen with reference to the specified transverse direction. For example, the extrusion billet may be of generally circular cross-section with one or two opposite segments arising. The extrusion may be subjected to thermomechanical treatment and/or vibration treatment. A preferred final thermomechanical treatment is also described.

13 Claims, 1 Drawing Sheet

DUCTILE ULTRA-HIGH STRENGTH ALUMINIUM ALLOY COMPONENTS

The present invention concerns a method of producing components of aluminium or alloys thereof having enhanced mechanical properties, particularly toughness and ductility in a transverse direction. The present invention also concerns a final thermomechanical treatment which further enhances mechanical properties.

The development of ultra high strength aluminium alloys, such as the 7000 series alloys (Registration Record of the Aluminium Association Inc.), has received much attention over the past 30 years or so. A particular problem with these materials is a reduction in overall ductility and, especially in the transverse directions and particularly the short transverse direction, mechanical properties such as ductility and fracture toughness. Attempts to improve transverse properties have largely employed the use of super pure base materials and/or a process of intermediate thermomechanical treatment (ITMT) seeAlluminio April 1975, pp 193–213, to produce a fine recrystallised grain structure.

It is known that the mechanical properties of precipitation hardened alloys can be markedly improved by the correct application of final thermomechanical processing techniques (FTMT). The attainment of ultra high strength in alloys such as those of the 7000 series has required that enriched compositions, particularly with regard to Zn, Mg and Cu be developed These rich alloys however present serious casting difficulties where large commercial size ingots are needed and work has therefore been done on small scale laboratory cast ingots or from alloys produced by powder routes.

It has been possible to obtain high values for longitudinal tensile properties but at the cost of a low ductility.

For example Roberts, Powder Metallurgy, AIME Interscience Publishers, New York 1961, obtained longitudinal tensile properties of 816 MPa with a 4% elongation with extruded powder compacts. Moreover Haar, Reports to Frankford Arsenal for period 1961–65 Alcoa Research Laboratories, obtained a value as high as 861 MPa but with low ductility using a powder route. In a separate study by Di-Russo, Alluminio Nuova Met., 1967, Vol. 36, pp 9–15, using small diameter direct chill ingots he obtained a strength level of 772 MPa with an elongation of 3%. Flemings and co-workers, Met. Trans. Vol. 1, January 1970, pp 191–197, obtained similar results using alloys rapidly solidified in ⅛" thick moulds and splat cooled samples. Values as high as 796 MPa tensile strength were obtained but with an elongation of only 1.8% after essentially cold working solution treated and aged materials. Mercier and Chevingny, Memoirs Scientifiques Rev. Metallurgy LX No. 1 1963, using a process of plastic deformation after complete T6 heat treatment recorded values as high as 740 MPa with an elongation of 3.5% for a 7000 series alloy A-Z8GU.

With regard to enriched compositions, U.S. Pat. No. 3,198,676 by Sprowls describes the application of thermal treatments for improved stress corrosion and fracture resistance.

Many thermomechanical studies involving the interaction of aging and plastic deformation have also been carried out on material produced from conventional D.C. cast ingots, with consequently lower strength, although improved fatigue performance, stress corrosion resistance, and fracture toughness have been reported. The lack of commercial use of final thermomechanical treatments in high strength 7000 series extrusions is a result of the poor transverse properties of these extrusions.

The use of vibrations induced in a component has been known for stress relief, particuarly in steel components but also for aluminium. The technique of Vibrational Stress Relieving (VSR) has been described in an article by R. A. Cloxton in The Journal of the Bureau of Engineer Surveyors, Volume 10, Nos. 1 and 3, 1983. Its use is as an alternative or in addition to thermal stress relief.

In the VSR technique, as typically applied for stress relief, a vibrator is engergised and scanned slowly up to its maximum frequency e.g. 0–200 Hz in about 10 minutes. The response of the component is monitored and when resonance is achieved the vibration frequency is held e.g. for about 2000 cycles, the time of holding will thus vary depending on the resonant frequency. The frequency may be then shifted until another resonant frequency is found.

The present inventors have now found that the problem of reduced ductility and fracture toughness can be overcome by directional upsetting of the extrusion billet along its entire length. Accordingly, in one aspect the present invention provides a method of producing an aluminium alloy component having improved properties in a specified transverse direction, which method comprises providing an extrusion billet of the aluminium alloy, compressing the billet to cause upsetting in at least one direction chosen with reference to a specified transverse direction, and extruding the upset billet to form the extrusion.

According to another aspect of the invention there is provided a final thermomechanical treatment for the further treatment of aluminium components which comprises the steps of solution treating, a pre-stretch of from 0–10% followed by a low temperature ageing at from room temperature to 115° C. followed by a second stretch of from 1–10% and a final ageing treatment from 2–24 hours at from 105° to 160° C.

In a further aspect of the present invention one or both of the stretching steps an the FTMT may be replaced by a vibrational treatment step, the present invention further provides a method of final thermomechanical treatment which comprises solution treatment, optional pre-stretch, first thermal ageing, vibration treatment and final thermal ageing.

The extrusion billet is preferably upset by compression longitudinally along its length whilst within a container, usually the billet container of the extrusion press, and as typically of a round cross-section, although the application of this invention is not limited to billets of only substantially round cross-section. Upon compression of the billet metal will be displaced transversely so as to fill the available space within the container and will be restrained from further movement by contact with the container walls. By provision of at least one side on the billet which is deliberately spaced from the container the metal of the billet will be displaced in a direction transverse to the side of the billet when compressed, i.e. the metal will be upset in a direction transverse to the sides of the billet. Preferably two parallel sides are provided since this will produce a more uniform upset in the billet. The sides are preferably in the form of flat faces.

Figure 1:
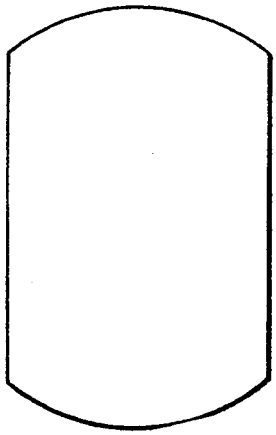
FIG. 1 shows a preferred form of billet as described in the present invention.

The most usual forms of extrusion billets have a substantially circular cross-section. Thus a billet according to the present invention may comprise a billet which has a cross-section which is generally circular but with at least one segment missing. A particularly preferred form of billet is a billet which has a generally circular cross-section from which two parallel and opposite segments are missing such as illustrated in FIG. 1.

The specified transverse direction can be any direction having a transverse component. The specific direction being determined by the positioning of the sides on the billet. Upset may be introduced in more than one direction by provision of appropriate sides on the billet. The mechanical properties may be improved in more than one transverse direction by upsetting the billet in more than one direction by provision of appropriate sides.

At least for simple components the greatest improvement in properties are obtained if the billet is upset in a direction substantially parallel to the direction in which the improved properties are desired. Thus the side or sides will be arranged to be substantially normal in relation to the specified transverse direction. However, improved properties are also obtained if the direction of upset is other than parallel to the specified transverse direction.

It is often found that ductility and fracture toughness is reduced toward the back end of an extrusion. To counteract this effect the billet may additionally be tapered, either by making it frustoconical, but retaining the appropriate flat faces, or the billet may remain cylindrical but with the width of the flat face increased toward the back end i.e. wedge shaped. A taper may be applied to the back-end of the billet such that the back-end of the billet has a cross-sectional area less than that of the front-end. Preferably the cross-sectional area of the back-end of the billet is from 15 to 70% of the front-end.

The taper is preferably applied to at least 25% of the length of the billet but may be applied to essentially the whole length of the billet. Tapering may be e.g. uniform or stepwise.

The sides may be provided by machining away the billet, by casting an appropriately shaped billet or by forging a cylindrical billet to the required shape.

The use of a non-cylindrical billet means that the entire working volume of the cylindrical container of the extrusion press is not filled and more so if the billet is also tapered. Thus the volume of metal that can be extruded and hence the length of extrudate would be smaller than with a cylindrical billet of equivalent length. Even if long extrusions are not required the efficiency of the extrusion press may be reduced relatively. In order to overcome this the shaped billet may be arranged to be somewhat longer than the container of the extrusion press, so that upsetting may be accomplished by initial movement of the extrusion ram. Alternatively, the billet may be upset within a separate container before being introduced in to the press container.

The present invention is applicable to both direct and and indirect extrusion processes and to both solid and hollow extruded sections.

The present invention is applicable to all high/ultra high strength aluminium alloys, particularly those of the 7000, 2000 series and the Al-Li alloys, for example 8090, 8091, 2090 and 2091 (Registration Record of the Aluminium Association Inc).

The present invention also concerns a final thermomechanical treatment suitable for further treatment of aluminium alloy components this FTMT comprises the steps of solution treating, a pre-stretch, low temperature ageing, a second stretch and a final ageing treatment.

The low temperature ageing treatment may be carried out from room temperature to 115° C., preferably from 80° to 105° C. The time required will depend on the ageing temperature; at room temperature this may be several weeks but at 115° C. ageing time can be as low as 1 hour.

This FTMT has the ability to deliver high strength values with an initial pre-stretch which has been previously shown to reduce the available strength with subsequent ageing. The pre-stretch is not an essential step but is preferably included since it allows stress relief in the material which is advantageous where subsequent machining is required. The preferred degree of stretch is from 1 to 4%.

The second stretch of from 1 to 10% can be carried out at room temperature but is preferably a warm stretch i.e. up to 200° C. most preferably 75° to 115° C.

The final ageing step is carried out at 105° to 160° C. for 2–24 hours, as previously, the higher the temperature the shorter the ageing time required.

In addition to, or as an alternative to, one or both of the stretching steps vibrational methods may be employed, e.g. by mechanical vibration of the extrusion at a frequency at or close to a resonant frequency. The use of vibration for stress relief VSR, is known for both steel and aluminium components, to the best of our knowledge, the technique has not previously been used with a thermomechanical treatment. It has surprisingly been found that use of vibrational treatment as part of a thermomechanical treatment increases the strength of Al components.

The present invention also provides for the use of a vibrational treatment as part of a thermomechanical treatment.

The vibrational treatment is applied as part of a final thermomechanical treatment. This treatment may be applied instead of, or more preferably as well as, e.g. intermediate the pre-ageing and final ageing treatments described above. The FTMT described above consists of the stages of solution treating, pre-stretch, first thermal ageing, second stretch and final thermal ageing. The vibrational treatment is preferably used instead of the second stretch the pre-stretch stage may be omitted if desired. Preferred parameters for the thermal ageing and optional stretching stage are as described above.

In the technique of the present invention the time of holding at resonant frequency, and thus the number of cycles applied, is much greater than used conventionally in VSR. Typically, according to the present invention the vibratory treatment would be applied for at least 0.5 minutes, preferably 1 to 10 minutes, more preferably 1 to 5 minutes typically about 3 minutes. Thus, for example, if one of the resonant frequencies of a component found to be at 100 Hz and vibration were applied at 100 Hz for 3 minutes, 18,000 cycles would be applied, this compares with 2,000 cycles typically applied in VSR. The frequency of vibration would usually be shifted until one or more further resonant frequencies was found and the vibration treatment applied at other of these resonant frequencies. Generally for a particular component several resonant frequencies are found and the vibration treatment can be applied at one or more of these frequencies. The resonant frequencies may also be varied by effectively altering the length of the component treated, e.g. with clamps, or by applying weights to the components.

This treatment is preferably applied to a cyclically hardenable aluminium alloy, i.e. a material which undergoes an increase in its monotonic strength following exposure to cyclic strain. It is preferably used in combination with components produced from directionally upset billets as previously described, although it is also useful for increasing the strength of other components such as plates or forgings.

When used together the combination of a directionally upset billet microstructure, which enhances the transverse properties, and/or an FTMT which may include vibrational processing, to increase strength, the combination provides much improved components in terms of overall properties. This processing route offers considerable scope to produce a "tailor made" microstructure where a particular mechanical property value must be obtained in a given direction or directions for a component.

The invention will now be illustrated by the following Examples in which all trials were performed on D.C. cast commercial purity 7000 series alloys, 7150 and 7075 plus an experimental alloy, 7049UH, having the following composition by %: Si,0.03; Fe,0.08; Cu,1.75; Mn,0.002; Mg,2.84; Cr,0.001; Zn,8.50; Ti,0.003; B,0.001; Zr,0.12 balance aluminium. All of these were conventionally cast by a DC process at 230 and 295 mm diameter and homogenised. Billets were then machined and extruded to produce a segmental section 70 mm in thickness which was subsequently solution treated by heating to 475° C. and quenching into cold water. Some of the sections were then mechanically stress relieved by a controlled stretch of 2.5%, others were left as solution treated. Comparison is made with a conventional age hardening designated T651 which is as follows for each of the alloys:

| T651 | 7049UH | 7150 | 7075 |
|---|---|---|---|
| Solution Treat | 475° C. | 475° C. | 475° C. |
| Stretch | 2.5% | 2.5% | 2.5% |
| Final age | 6 hrs - 120° C. plus 4 hrs - 150° C. | 6 hrs - 120° C. plus 4–6 hrs - 160° C. | 12 hrs - 135° C. |

EXAMPLE 1

This example illustrates the effect of the thermal treatment applied to extrusions made from ordinary round extrusion billet.

Longitudinal tensile test specimens were machined from extrusions and subjected to a thermomechanical processing route involving preage/warm stretching and final aging.

Pre-ageing was performed at 90° C. and 105° C. from between 1 and 5 hours with warm stretching between 1 and 8% achieved at the same temperature.

Final aging was carried out at 120° C. for between 4 and 24 hours.

Some typical examples of the tensile properties developed for the three alloys are shown in Table 1.

EXAMPLE 2

An extrusion was produced as described above then the entire extrusion was subjected to the heat and stretching shown in Table 2 which also shows the mechanical properties obtained.

EXAMPLE 3

The increase in longitudinal tensile strength associated with the thermomechanical processing can, however, result in a reduction in the transverse properties.

To overcome this problem a process of directional upsetting was employed to enhance the mechanical properties in both the L.T. and S.T. directions while maintaining the longitudinal properties. This was achieved by machining parallel flats on the billets as shown in FIG. 1 and orientating the billet with the die to obtain the necessary enhancement of properties. Table 3 shows the results obtained after a combination of final thermomechanical processing using conventional and directionally upset billets. The final thermomechanical processing involved pre-ageing for 4 hours at 90° C., warm stretching to 2% at 90° C. and final aging at 120° C. for 16 hours. The material used was 7150. With reference to table 3:

Conventional means conventional round billet.

(b) Parallel flats vertical means the flat faces are parallel to the direction in which enhanced short ductility is desired.

(c) Parallel flats horizontal i.e. at right angles to (b).

TABLE 1

| ALLOY | STRETCH | HOURS | WARM STRETCH | FINAL AGE 120° C. HRS | MECHANICAL PROPERTIES .2% PROOF STRENGTH MPa | UTS MPa | % ELONGATION |
|---|---|---|---|---|---|---|---|
| | | PRE-AGE 90° C. | 90° C. | | | | |
| 7049 UH | 2.5% | 1/4 | 4% | 4/12 | 741/762 | 759/778 | 6.5/7.0 |
| 7049 UH | — | 3 | 2% | 4/16 | 725/748 | 756/766 | 6.9/7.0 |
| 7049 (T651) | | | | | 704 | 725 | 7.5 |
| 7150 | 2.5% | 4 | 5% | 12/20 | 678/688 | 706/713 | 7.0/7.5 |
| 7150 | — | 4 | 2% | 12/20 | 643/662 | 685/698 | 9.0/9.2 |
| 7150 (T651) | | | | | 610 | 665 | 9.5 |
| 7075 | — | 4 | 4% | 4/20 | 598/608 | 643/654 | 8.4/8.1 |
| 7075 (T651) | | | | | 571 | 611 | 9.2 |
| | | PRE-AGE 105° C. | 105° C. | | | | |
| 7150 | — | 2 | 5/7% | 12 | 680/699 | 704/722 | 7.5/9.3 |
| 7075 | | 2 | 8% | 12/16 | 633/631 | 661/660 | 4.4/7.2 |

TABLE 2

| Alloy | Stretch | Pre-age 90° C. (Hrs) | Warm Stretch | Final Age 120° C. (Hrs) | Mechanical Properties .2% Proof MPa | UTS MPa | % Elongation |
|---|---|---|---|---|---|---|---|
| 7049 UH | 2.5% | 4 | 1% | 16 | 726 | 749 | 7.2 |
| 7049 UH | — | 4 | 1% | 16 | 725 | 748 | 7.0 |
| 7150 | 2.5% | 4 | 2% | 16 | 674 | 691 | 7.5 |

TABLE 3

| | .2% PROOF STRENGTH MPa | | | UTS MPa | | | % ELONGATION | | |
|---|---|---|---|---|---|---|---|---|---|
| BILLET | L | LT | ST | L | LT | ST | L | LT | ST |
| CONVENTIONAL | 674 | 544 | 472 | 691 | 605 | 589 | 7.5 | 4.0 | 2.8 |
| PARALLEL FLATS VERTICAL TO DIE | 670 | 569 | 519 | 695 | 622 | 605 | 8.5 | 5.9 | 3.8 |
| PARALLEL FLATS HORIZONTAL TO DIE | 658 | 532 | 508 | 686 | 600 | 595 | 9.0 | 8.6 | 5.7 |

The values of tensile strength and ductility recorded here are higher than those previously reported in the literature produced from a conventional D.C. casting route and thermomechanically processed. (Di-Russo, Met. Trans. Vol. 4, April 1973, 1132, has recorded the highest tensile strength of 730 MPa with a longitudinal elongation of 3.4% for an extruded 7075, the extrusion ratio was however, =60:1 and conventional T6 yielded a value of 696 MPa). Moreover these current values approach those cited in the literature for the rich (upto 14% Zn, 3.5% Mg, 2.0% Cu alloys) laboratory scale materials.

The specimen "parallel flats horizontal to die" in Table 3 was used to obtain data on fracture toughness. Results are set out in the following Table 4. Duplicate tests were performed at the front-end and the back-end of the extrusion. Fracture toughness for a test piece from extrusion of a conventional billet in SL direction are shown for comparison. Fracture toughness was determined using ASTM 399/83 test procedure.

TABLE 4

| Extrusion Position | Specimen Orientation | Fracture Toughness ($MNm^{-3/2}$) |
|---|---|---|
| Front | Transverse - Longitudinal | 23.60/20.08 |
| | Short Transverse - Longitudinal | 23.97/22.00 |
| Back | Transverse - Longitudinal | 19.26/19.61 |
| | Short Transverse - Longitudinal | 19.07/19.66 |
| Conventional billet back | Short Transverse - Longitudinal | 16.85/17.10 |

EXAMPLE 4

This experiment involved the extrusion of 60 mm diameter billets of 7150 alloy to produce 9.5 mm diameter rod which was subsequently solution treated for one hour at 475° C.±2° C. and quenched into cold water. The rods were then cut into 3 m sections and pre-aged for 4 hours at 90° C. One set of rods were then finally aged for between 0 and 24 hours at 120° C.

A further set of rods were exposed to a vibratory deformation procedure, the specimens being vibrated for 3 minutes at each of 3 resonant frequencies for a total of 9 minutes. These specimens were then given the same final ageing practice. The results of this trial are shown in Table 5 below and demonstrate the potential of this technique to provide strength enhancement via a thermomechanical ageing procedure.

TABLE 5

| | Final Ageing Time (Hrs.) | Longitudinal UTS (MPa) |
|---|---|---|
| Vibration | 0 | 690 |
| | 24 | 720 |
| No Vibration | 0 | 650 |
| | 24 | 670 |

Thus the present Invention allows the production of high/ultra high strength aluminium alloys with improved ductility and allows the microstructural control required to develop ultra high strength aluminium alloy extrusions with directional mechanical properties.

What is claimed is:

1. A method of producing an extruded aluminum alloy component having improved properties in a specified direction transverse to the extrusion direction, which method comprises providing an extrusion billet of the aluminum alloy, compressing the billet to cause upsetting in to the specified direction, and extruding the upset billet to form the extruded component.

2. A method as claimed in claim 1, wherein the extrusion billet has a cross-section which is generally circular but with at least one segment missing.

3. A method according to claim 2, wherein one or more sides are in the form of one or more flat faces on the billet.

4. A method as claimed in claim 2, wherein the extrusion billet has a generally circular cross-section from which two parallel and opposite segments are missing.

5. A method as claimed in claim 1, wherein the extrusion billet has at least one side substantially normal to the specified direction, which side extends along the entire length of the billet.

6. A method according to claim 1, wherein the properties are improved in more than one given direction in the extrusion.

7. A method according to claim 1, wherein the billet is additionally tapered.

8. A method of producing an extruded aluminum alloy component having improved properties in a specified direction transverse to the extrusion direction, which method comprises providing an extrusion billet of the aluminum alloy, compressing the billet to cause upsetting in at least one direction chosen with reference to the specified direction, and extruding the upset billet to form the extruded component, wherein the extruded component is subjected to thermomechanical treatment comprising the steps of solution treatment, an optional pre-stretch, pre-ageing, final stretch, and final ageing.

9. A method as claimed in claim 8, wherein the thermomechanical treatment comprises the steps of solution treatment, pre-stretch of 0–10%, pre-ageing at room temperature to 115° C., final stretch of 1–10%, and final ageing for 2–24 hours at 105°–160° C.

10. A method of producing an extruded aluminum alloy component having improved properties in a specified direction transverse to the extrusion direction, which method comprises providing an extrusion billet of the aluminum alloy, compressing the billet to cause upsetting in a direction substantially parallel to the specified direction, and extruding the upset billet to form the extruded component, wherein the extruded component is subjected to thermomechanical treatment comprising the steps of solution treatment, an optional pre-stretch, pre-aging, vibration treatment and final aging, wherein the vibration treatment is applied at or close to a resonant frequency of the component.

11. A method according to claim 10, wherein the virbration treatment is applied at more than one of the resonant frequencies for the component.

12. A method according to claim 10, wherein the vibration treatment is applied for a period of at least 0.5 minutes.

13. A method according to claim 10, wherein the optional pre-stretch is from 0–10%, pre-aging is from room temperature to 115° C. and the final aging is from 105° to 160° C. for 2 to 24 hours.

* * * * *

UNITED STATES PATENT AND TRADEMARK OFFICE

CERTIFICATE OF CORRECTION

PATENT NO. : 5,413,650

DATED : May 9, 1995

INVENTOR(S) : Martin Roy Jarett and William Dixon

It is certified that error appears in the above-indentified patent and that said Letters Patent is hereby corrected as shown below:

Column 8, claim 1, line 6, after "upsetting in", insert

—a direction substantially parallel to—.

Signed and Sealed this

Ninth Day of January, 1996

Bruce Lehman

*Attest:*

BRUCE LEHMAN

*Attesting Officer*

*Commissioner of Patents and Trademarks*